United States Patent [19]

Ishihara

[11] Patent Number: 5,039,975

[45] Date of Patent: Aug. 13, 1991

[54] RESISTOR SUBSTRATE

[75] Inventor: Kanji Ishihara, Miyagi, Japan

[73] Assignee: Alps Electric Co., Ltd., Tokyo, Japan

[21] Appl. No.: 516,380

[22] Filed: Apr. 30, 1990

[30] Foreign Application Priority Data

Jul. 3, 1989 [JP] Japan ..... 1-77630[U]

[51] Int. Cl.[5] ..... H01C 1/012

[52] U.S. Cl. ..... 338/312; 338/164; 338/184; 338/197; 338/237; 338/323

[58] Field of Search ..... 338/312, 164, 184, 197, 338/237, 323, 324, 325, 162

[56] References Cited

U.S. PATENT DOCUMENTS 3,518,604 6/1970 Beaver et al. ..... 338/164
4,355,293 10/1982 Driscoll .
4,429,297 1/1984 Nakatsu ..... 338/162
4,430,634 2/1984 Hufford et al. .

*Primary Examiner*—Marvin M. Lateef
*Attorney, Agent, or Firm*—Guy W. Shoup; David W. Heid

[57] ABSTRACT

A resistor substrate for a variable resistor of the enclosed type which may be employed in a throttle sensor of an automobile. The resistor substrate has a disk portion and a rectangular apron provided at a circumferential portion of the disk portion. The apron is stepped with respect to the disk portion to form a reduced thickness portion, and a plurality of projections each having an arcuate section in a widthwise direction are formed at end portions of the reduced thickness portion of the apron. A plurality of terminals are embedded at base portions thereof in the disk portion and extend along a surface of the reduced thickness portion of the apron. The terminals individually have arcuate protruded portions formed therein in accordance with a configuration of the projections of the apron, and the projections individually have lateral holes formed therein in an opposing relationship to the protruded portions of the terminals such that they extend to the protruded portions. When the resistor substrate is fitted in the casing, the apron of the resistor substrate contacts with a flange portion provided on the casing.

3 Claims, 5 Drawing Sheets

RESISTOR SUBSTRATE

BACKGROUND OF THE INVENTION

1. Field of the Invention

This invention relates to a variable resistor for use with a throttle sensor of an automobile or the like, and more particularly to a resistor substrate which is employed in a variable resistor for a throttle sensor of an automobile or the like.

2. Description of the Prior Art

A wide variety of variable resistor constructions are presently available, and a resistor substrate is employed in such variable resistor sensors. An exemplary one of conventional variable resistor constructions is shown in FIGS. 5 to 9.

Referring to FIGS. 5 to 9, the exemplary variable resistor construction shown includes a casing 1 made of an insulating material and composed of a variable resistor casing 2 and a terminal casing 3. As particularly shown in FIGS. 7 and 8, the variable resistor casing 2 has a cylindrical portion 4, a pair of vertical side walls 5 extending downwardly from the circumferential opposite ends of the cylindrical portion 4, and a horizontal side wall 6 extending in a horizontal direction to connect the vertical side walls 5 to each other. An operating shaft 7 is mounted for rotation in the casing 2, and a spring 8 for the automatic returning movement in the form of torsion coil spring is interposed between the casing 2 and the operating shaft 7. A slider receiver 9 is secured to the operating shaft 7 and has a slider 10 secured thereto. A resistor substrate 11 has a disk portion 12 having a linearly cut recess 13 formed thereon, and three terminals 14 are mounted on the disk portion 12 of the resistor substrate 11 adjacent the recess 13. In particular, as particularly seen in FIG. 9, the terminals 14 are embedded at base portions thereof in the disk portion 12 and held in contact with a resistive body 15 while they are projected at the other end portions thereof outwardly from the recess 13 of the disk portion 12 of the resistor substrate 11. Each of the terminals 14 has an arcuately protruded portion 16 formed at an intermediate portion of the outwardly projected portion thereof and further has a connecting portion 18 provided at an end of the outwardly projected portion thereof for the connection to a corresponding one of three terminals 17 embedded in the terminal casing 3.

The variable resistor casing 2 has a flange portion 19 formed on an inner periphery of the cylindrical portion 4 thereof while an arcuate flange portion 20 is formed between the vertical side walls 5 and extends along an arcuate extension line of the cylindrical portion 4. The flange portion 20 lies in a common plane with the flange portion 19 of the variable resistor casing 2 so that the slider receiver 9 may rotate under the guidance of the flange portions 19 and 20.

In assembling the resistor substrate 11 to the resistor substrate casing 2, the disk portion 12 of the resistor substrate 11 is placed onto the flange portion 19 of the cylindrical portion 4 of the casing 2 such that a pair of small inward projections 22 formed at diametrical positions on the inner periphery of the cylindrical portion 4 may be fitted into a pair of small recesses 21 formed on the opposite sides of the resistor substrate 11 to mount the resistor substrate 11 on the casing 1 as shown in FIG. 7 so as to prevent relative rotation between them. After then, the connecting portions 18 at the ends of the terminals 14 are secured to ends of the terminals 17 by means of solder 23. A cover 24 is fitted in the cylindrical portion 4 of the cover 2 so as to cover over the resistor substrate 11, and resin material 25 is filled in a spacing between the cover 24 and the cylindrical portion 4 of the casing 2 to seal the resistor construction. Referring to FIG. 6, reference numeral 26 denotes a washer, 27 a seal, and 28 a wave washer.

With the resistor construction, if the operating shaft 7 is turned around its axis, then the slider receiver 9 is rotated together with the operating shaft 7 to slidably move the slider 10 on the slider receiver 9 along the resistive body 15 on the resistor substrate 11 while the returning spring 8 is resiliently distorted thereby to change the resistance of the variable resistor. On the hand, if the turning force to the operating shaft 7 is removed, then the slider receiver 9 is rotated back to its original inoperative position by the resilient returning force of the returning spring 8.

It is to be noted that, while such variable resistor may sometimes be installed at a location where it undergoes a comparatively great variation in temperature, since each of the terminals 14 has the arcuate protruded portion 16 formed thereon, possible expansion and contraction of the components of the resistor by such temperature variation can be permitted.

By the way, with the conventional resistor construction described above, since an air gap 29 is formed between the resistor substrate 11 at the recess 13 and the arcuate flange portion 20 of the casing 2, there is a drawback that, when the connecting portions 18 of the terminals 14 are soldered to the terminals 17, a waste fraction of solder may possibly pass through the air gap 29 and stick to the slider 10 on the slider receiver 9, which will cause irregular operation of the resistor.

One of possible solutions to the problem is formation on the resistor substrate 11 of an extension which extends farther than the arcuate flange portion 20 and is held in contact with the arcuate flange portion 20 to close up the air gap 29. In this instance, however, the terminals 14 are arranged so as to extend from an end portion of the extension of the resistor substrate 11, which requires a corresponding additional spacing. Accordingly, there is a drawback that the casing 2 is increased in overall size.

SUMMARY OF THE INVENTION

It is an object of the present invention to provide a resistor substrate for a variable resistor which can prevent a waste fraction of solder upon soldering of terminals from sticking to a slider of the variable resistor without increasing the overall size of a casing of the slider resistor.

In order to attain the object, according to the present invention, there is provided a resistor substrate adapted to be fitted in a casing of a variable resistor or the like having a flange portion formed therein, the resistor substrate having a disk portion and a rectangular apron provided at a circumferential portion of the disk portion, the apron being stepped with respect to the disk portion to form a reduced thickness portion at end portions of which a plurality of projections or ribs each having an arcuate section in a widthwise direction of the apron are formed, the resistor substrate further having a plurality of terminals having base portions embedded in the disk portions, the terminals extending along a surface of the reduced thickness portion of the apron, each of the terminals having an arcuate protruded portion formed at an intermediate portion thereof in accordance with a configuration of a corresponding one of the projections of the apron, each of the projections of the apron having a lateral hole formed at a portion thereof opposing to the protruded portion of a corresponding one of the terminals such that the hole extends to the protruded portion of the corresponding terminal, the apron being provided such that, when the resistor substrate is fitted in the casing, the apron contacts with the flange portion of the casing.

Preferably, the apron contacts with the flange portion provided between a pair of vertical side walls of the casing to close up an air gap which may be formed between the resistor substrate and the flange portion of the casing and communicate with a front face of a slider receiver of the variable resistor or the like. Thus, when ends of the terminals are soldered to other terminals for the external connection, a waste fraction of solder can be prevented from being admitted to the slider receiver of the variable resistor.

Preferably, the arcuate protruded portions formed on the terminals which are partially embedded in and secured to the resistor substrate are exposed to the outside of the variable resistor or the like by way of the lateral holes formed in the projections of the resistor substrate in an opposing relationship to the arcuate protruded portions. The protruded portions of the terminals may be held in engagement with the projections on the apron of the resistor substrate. Thus, the terminals can be accommodated sufficiently to expansion or contraction of the associated components caused by a variation in temperature. Further, since the protruded portions of the terminals are formed making use of the apron of the resistor substrate, the position of the connecting portions at the ends of the terminals can be maintained as in a conventional variable resistor in spite of additional provision of the apron, and accordingly, the overall size of the casing of the variable resistor can be maintained.

The above and other objects, features and advantages of the present invention will become apparent from the following description and the appended claims, taken in conjunction with the accompanying drawings in which like parts are denoted by like reference characters all through the drawings.

DETAILED DESCRIPTION OF THE PREFERRED EMBODIMENT

Figure 1:
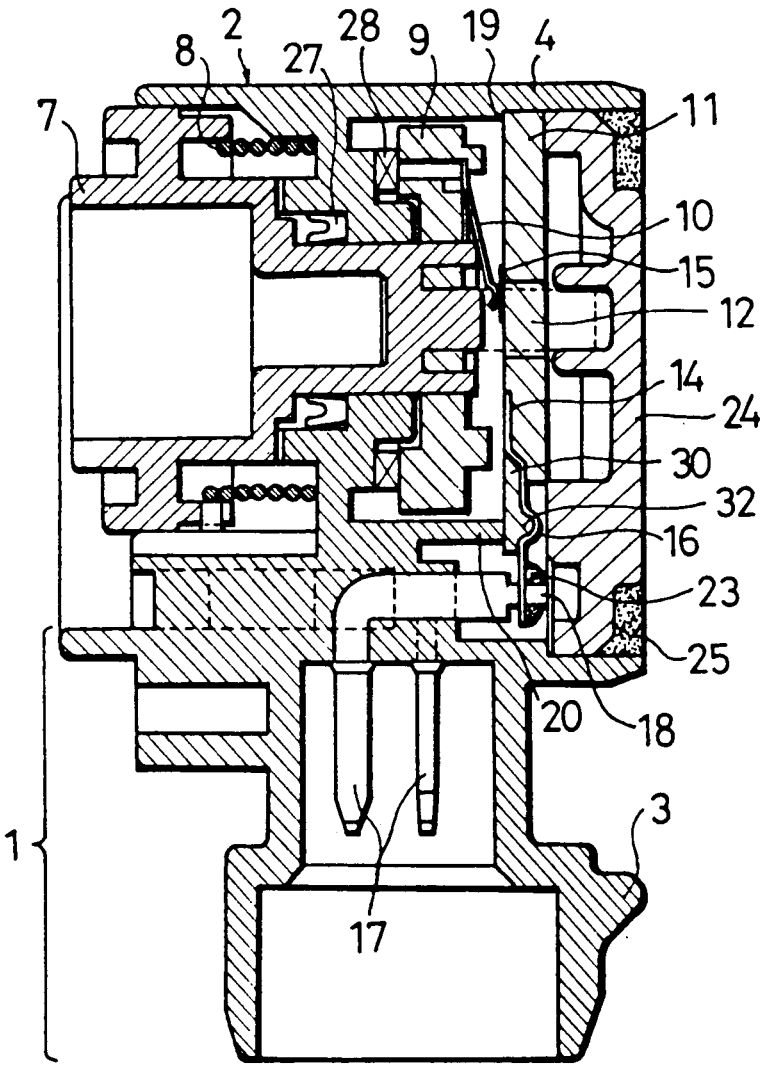
FIG. 1 is a sectional view of a variable resistor in which a resistor substrate according to the present invention is incorporated.

Referring to FIGS. 1 to 4, there is shown a variable resistor in which a resistor substrate according to the present invention is incorporated. The variable resistor has substantially similar construction to that of the conventional variable resistor described hereinabove with reference to FIGS. 5 to 9, and overlapping description of such common construction is omitted herein to avoid redundancy. In particular, the variable resistor is only different in structure of a resistor substrate 11 thereof from that of the conventional variable resistor, and accordingly, the resistor substrate 11 will be described in detail below.

The resistor substrate 11 is constructed in accordance with the present invention and has a disk portion 12 and a rectangular apron 30 provided at a circumferential portion of the disk portion 12. As particularly seen in FIG. 4, the apron 30 of the resistor substrate 11 is stepped or offset with respect to the disk portion 12 to form a reduced thickness portion 31 thereon. The reduced thickness portion 31 of the apron 30 has three ribs or projections 32 formed at lower end portions thereof. Each of the projections 32 has an arcuate sectional shape in a widthwise direction of the apron 30 transverse to terminals 14. The terminals 14 are embedded at base portions thereof in the disk portion 12 and connected to a resistive body 15 on a left face in FIG. 4 of the resistor substrate 11. The terminals 14 extend through the resistor substrate 11 and then along an opposite surface, a right surface in FIG. 4, of the reduced thickness portion 31 of the apron 30 and individually have arcuate protruded portions 16 formed at intermediate portions thereof in accordance with a configuration of the projections 32 of the apron 30. The apron 30 has three lateral holes 33 formed at portions of the projections 32 thereof opposing to the protruded portions 16 of the terminals 14 such that they extend to the protruded portions 16 of the terminals 14. Each of the terminals 14 has a connecting portion 18 formed at a free end thereof for the connection to a corresponding terminal 17.

Figure 2:
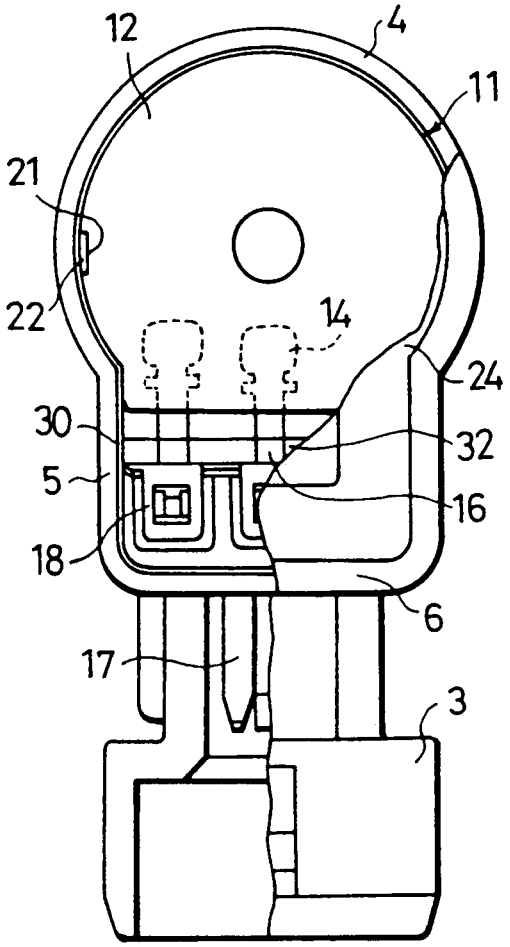
FIG. 2 is a plan view of the variable resistor of FIG. 1 with a cover partly cut away.
Figure 3:
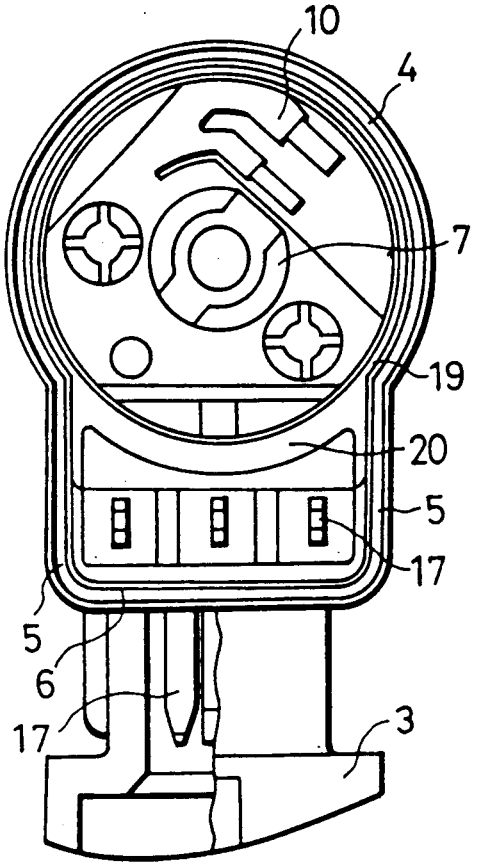
FIG. 3 is a plan view of the variable resistor of FIG. 1 with the resistor substrate removed.
Figure 4:
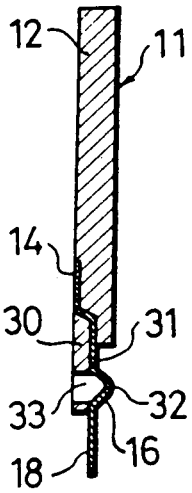
FIG. 4 is a vertical sectional view of the resistor substrate shown FIG. 1.
Figure 5:
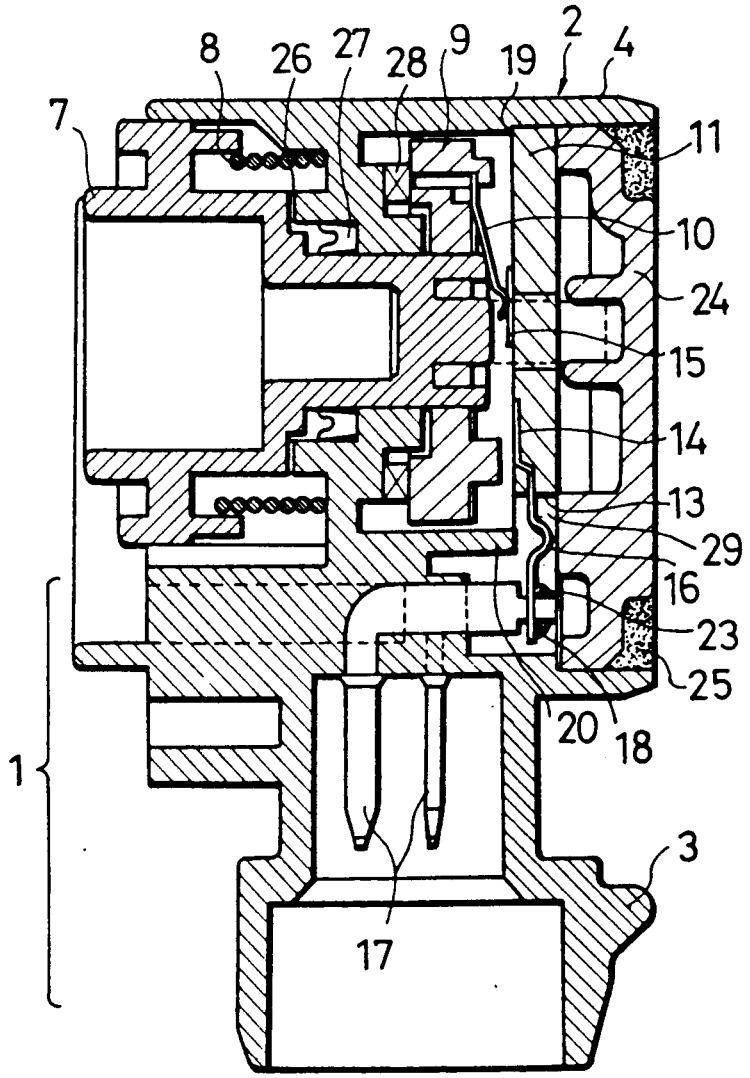
Fig. 5 PRIOR ART
FIG. 5 is a sectional view of a conventional variable resistor.
Figure 6:
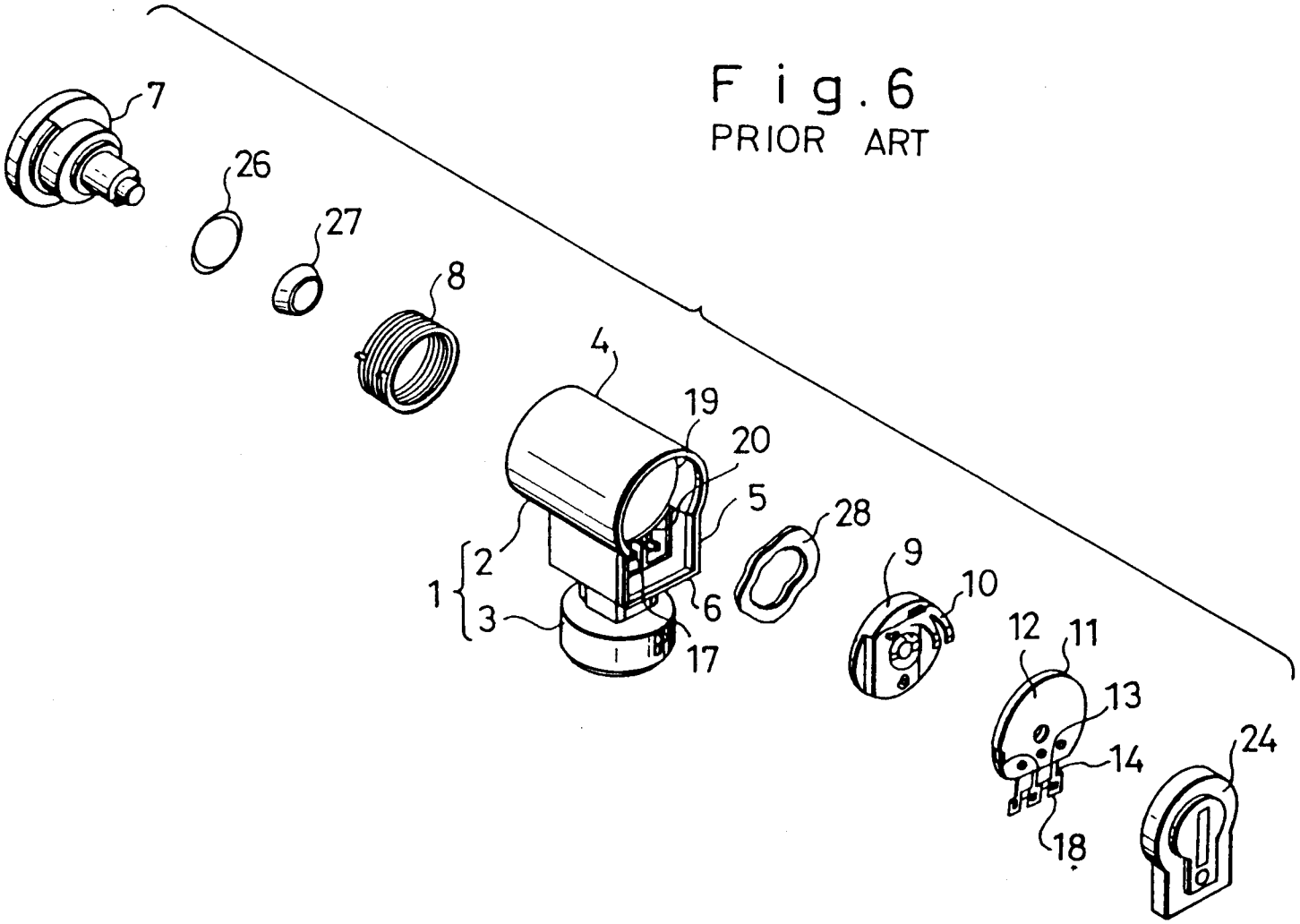
Fig. 6 PRIOR ART
FIG. 6 is a fragmentary perspective view of the variable resistor of FIG. 5.
Figure 7:
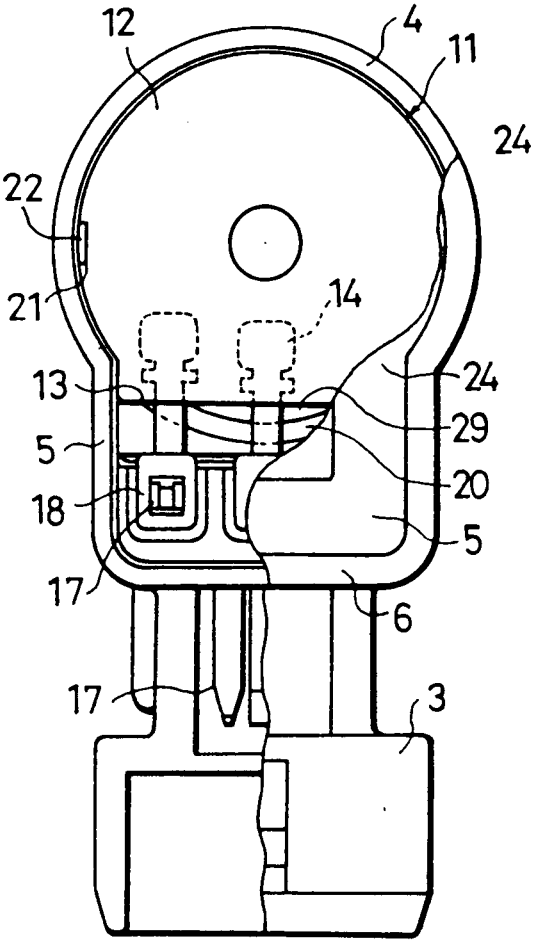
Fig. 7 PRIOR ART
FIG. 7 is a plan view of the variable resistor of FIG. 5 with a cover partly cut away.
Figure 8:
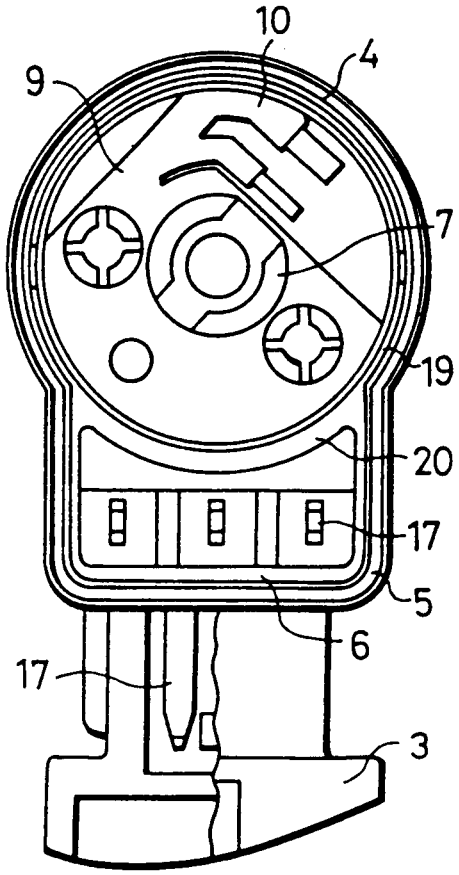
Fig. 8 PRIOR ART
FIG. 8 is a plan view of the variable resistor of FIG. 5 with a resistor substrate removed.
Figure 9:
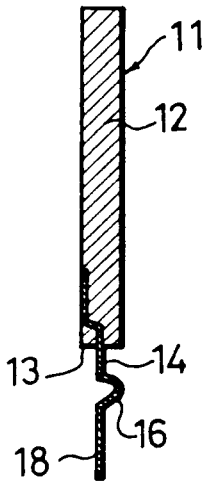
Fig. 9 PRIOR ART
FIG. 9 is a sectional view of the variable resistor shown in FIG. 5.

In assembling the resistor substrate 11 of the construction described above to the casing 2, the disk portion 12 of the resistor substrate 11 is placed onto the flange portion 19 on the inner periphery of the cylindrical portion 4 of the casing 2 such that the pair of small inner projections 22 formed at diametrical positions on the inner periphery of the cylindrical portion 4 may be fitted into the pair of small recesses 21 formed on the opposite sides of the resistor substrate 11 to mount the resistor substrate 11 on the casing 1 as shown in FIG. 2 so as not to permit relative rotation between them. In this instance, the apron 30 contacts with the arcuate flange portion 20 of the casing 2 over the entire horizontal length of the latter as seen in FIG. 1. After then, the connecting portions 18 at the ends of the terminals 14 are secured to ends of the terminals 17 by means of solder 23.

With the resistor substrate of the construction described above, since the disk portion 12 of the resistor substrate 11 lies on the flange portion 19 on the inner periphery of the cylindrical portion 4 of the casing 2 and the apron 30 contacts with the arcuate flange portion 20 formed between the pair of vertical side walls 5 of the casing 2 so that a surface of the slider receiver 9 is covered over completely by the resistor substrate 11, when the terminals 17 are to be secured to the connecting portions 18 at the ends of the terminals 14 by means of solder 23, no waste fraction of such solder will be admitted to the front face of the slider receiver 9.

Further, since the projections 32 are provided on the apron 30 of the resistor substrate 11 and the protruded portions 16 of the terminals 14 are formed on the terminals 14 making use of the protruded portions 32 such that they may be exposed to the outside of the variable resistor by way of the lateral holes 33 formed in the projections 32 of the apron 30 just behind the protruded portions 16, the terminals 14 can be expanded or contacted in response to a temperature variation of the outside similarly as in a conventional variable resistor.

In addition, since the protruded portions 16 of the terminals 14 are formed making use of and adjacent the apron 30, the location of the connecting portions 18 of the terminals 14 need not be changed from that in a conventional variable resistor, and accordingly, the overall size of the casing 2 of the variable resistor can be maintained.

Having now fully described the invention, it will be apparent to one of ordinary skill in the art that many changes and modifications can be made thereto without departing from the spirit and scope of the invention as set forth herein.

What is claimed is:

1. A resistor substrate adapted to be fitted in a casing of a variable resistor having a flange portion provided between a pair of vertical side walls of said casing to close an air gap which may be formed between said resistor substrate and said flange portion of said casing and communicate with a front face of a slider receiver of said variable resistor, said resistor substrate having a disk portion and a rectangular apron provided at a circumferential portion of said disk portion, said apron being stepped with respect to said disk portion to form a reduced thickness portion at end portions of which a plurality of projections each having an arcuate section in a widthwise direction of said apron are formed, said resistor substrate further having a plurality of terminals having base portions embedded in said disk portions and free ends connected to said casing, said terminals extending along a surface of said reduced thickness portions of said apron, each of said terminals having an arcuate protruded portion formed at an intermediate portion thereof in accordance with a configuration of a corresponding one of said projections of said apron.

2. A resistor substrate according to claim 1, wherein each of said projections of said apron having a lateral hole formed at a portion thereof opposing to said arcuate protruded portion of a corresponding one of said terminals such that said hole extends to the arcuate protruded portion of the corresponding terminal, said apron being provided such that said apron contacts with said flange portion of said casing.

3. An improved variable resistor for variable temperature applications comprising:

a variable resistor casing having a cylindrical wall defining a cylindrical recess having an open end and a closed end, a portion of said cylindrical wall adjacent said open end defining a notch having a flange portion with a surface lying in a first plane parallel to a plane defined by an edge of said open end, an inner surface of said cylindrical wall defining a flange, said flange and said arcuate surface substantially lying in said first plane;

vertical side walls connected to said cylindrical wall adjacent said notch, said vertical side walls defining a slot such that said slot and said cylindrical recess form a key-hole shaped recess;

a slider receiver rotatably disposed in said cylindrical recess adjacent said closed end, and having a slider fixedly mounted on said slider receiver; and a resistor substrate having a first side disposed against said flange, a resistive body being disposed on said first side such that said resistive body is in contact with said slider, a plurality of terminals having one end embedded in said resistive substrate and a free end disposed remotely from said resistor substrate and connected to said variable resistor casing, a portion of said terminals being bent to form an arcuate protruded portion for relieving stresses caused by thermal expansion;

wherein said improvement comprises said resistor substrate has a rectangular apron disposed over said flange portion, said rectangular apron portion having arcuate projections disposed adjacent said arcuate protruded portions of said terminals, said rectangular portion defining holes disposed immediately adjacent said arcuate projections such that said cylindrical recess is substantially isolated from said free ends of said terminals and said arcuate protruded portions are free to move in response to thermal expansion.

* * * * *